US005948349A

United States Patent [19]

Beurotte et al.

[11] Patent Number: 5,948,349

[45] Date of Patent: Sep. 7, 1999

[54] LADLE FOR THE PREPARATION OF METAL PROVIDED WITH A REFRACTORY BOTTOM LINING AND METHOD FOR PRODUCING SAID REFRACTORY BOTTOM LINING

[75] Inventors: Michel Beurotte, Dunkerque; Pierre de Lafarge, Epernay, both of France

[73] Assignees: Sollac, Uteaux; LaFarge Refractaires Monolithiques, Montrouge Cedex, both of France

[21] Appl. No.: 07/963,524

[22] Filed: Oct. 20, 1992

Related U.S. Application Data

[63] Continuation of application No. 07/606,199, Oct. 31, 1990, abandoned.

[30] Foreign Application Priority Data

Nov. 17, 1989 [FR] France ..... 89 15128

[51] Int. Cl.[6] ..... C21B 13/00

[52] U.S. Cl. ..... 266/44; 266/275; 266/280

[58] Field of Search ..... 266/44

[56] References Cited

U.S. PATENT DOCUMENTS

| | | | |
|---|---|---|---|
| 1,292,582 | 1/1919 | Coulson | 266/275 |
| 3,333,746 | 8/1967 | Cope et al. | 266/275 |
| 4,746,102 | 5/1988 | Gilles et al. | 266/275 |
| 4,942,986 | 7/1990 | Lewis et al. | 266/275 |

FOREIGN PATENT DOCUMENTS 2095982 2/1972 France .

*Primary Examiner*—Scott Kastler
*Attorney, Agent, or Firm*—Pillsbury, Madison & Sutro LLP

[57] ABSTRACT

The invention provides a ladle for the preparation of metal comprising a metal case (1) provided, on its inner surface, with a refractory wall lining (3) and a refractory bottom lining (4) with a taphole (5), characterized in that the surface of the refractory bottom lining (4) in contact with the metal in preparation is a concave surface having at every point a slope in the direction toward the taphole (5).

The invention also provides a method for producing such a refractory bottom lining.

9 Claims, 3 Drawing Sheets

LADLE FOR THE PREPARATION OF METAL PROVIDED WITH A REFRACTORY BOTTOM LINING AND METHOD FOR PRODUCING SAID REFRACTORY BOTTOM LINING

This is a continuation of application Ser. No. 07/606,199, filed on Oct. 31, 1990, which was abandoned upon the filing hereof.

The present invention relates to a ladle for the preparation of a metal, comprising a metal case provided, on the inner surface thereof, with a refractory wall lining and a refractory bottom lining having a taphole.

The invention also relates to a method for producing such a refractory bottom lining.

In the metallurgical field, such a ladle is known and, in steelworks, it is desired to provide bottom linings of ladles which have a slope toward the taphole for improving the flow of the metal at the end of the pouring and thereby reducing losses of metal.

But a ladle bottom lining which is flat and inclined has for main drawback the fact that it rises under the effect of the thermal expansion of the refractory materials in the course of the heating of the ladle. This phenomenon is still more serious when there are employed basic materials whose coefficient of expansion is higher than that of acid materials.

The expansions produce, by a detachment at the centre between the lining and the bottom of the ladle, a buckling of said bottom lining.

This type of deformation may result in a rapid deterioration and a dropping out of the refractory bottom lining when emptying the slag.

An object of the present invention is to avoid, among other things, the detachment of the bottom refractory lining of a ladle employed for the preparation of metal, for example steel.

The invention therefore provides a ladle for the preparation of metal comprising a metal case provided, on the inner surface thereof, with a refractory wall lining and a refractory bottom lining having a taphole, characterized in that the surface of the refractory bottom lining in contact with the metal being prepared is a concave surface having at every point a slope in a direction toward the taphole.

Preferably, the refractory bottom lining is formed by at least an assembly of independent elements separated by joints, said independent elements being obtained by moulding and being so constructed and arranged as to provide a vault effect when the ladle is turned over.

According to a particular embodiment of the invention, the refractory bottom lining is constituted by at least one safety layer and at least one wear layer, the safety layer being constituted by an assembly of independent elements.

According to other features of the invention:

the independent elements of the bottom of the ladle have lateral surfaces provided with at least one groove extending in a direction substantially parallel to the surface of the bottom of the ladle;

the independent elements of the bottom of the ladle are sealed with a concrete having a permanent positive remanent dimension variation;

the assembly of the independent elements of the ladle bottom forms a mosaic having joints some of which are concentric with the taphole and others radiate relative to the taphole, the radiating joints being offset from one concentric joint to the other;

the safety layer is surrounded by an annular girdle capable of constituting a surface for commencing the masonry of the refractory lining of the wall of the metal case;

the annular girdle which has a substantially quadrilateral sectional shape comprises at least one outer shoulder defining at least one helical support surface, the width of the support surface corresponding to the thickness of at least one layer of refractory wall lining.

The invention also provides a method for producing a refractory bottom lining, said method comprising:

producing a mould formed by a convex, preferably substantially spherical, bottom including vertical walls constituting compartments corresponding to the geometry of the elements of the refractory bottom lining, said walls having a section similar to the section of the joints;

pouring into each compartment thus formed a selected refractory concrete;

stripping from each compartment after the setting of the concrete and providing a reference on each of said elements of the refractory bottom lining.

Further features and advantages of the invention will be apparent from the following description with reference to the accompanying drawings.

Figure 1:
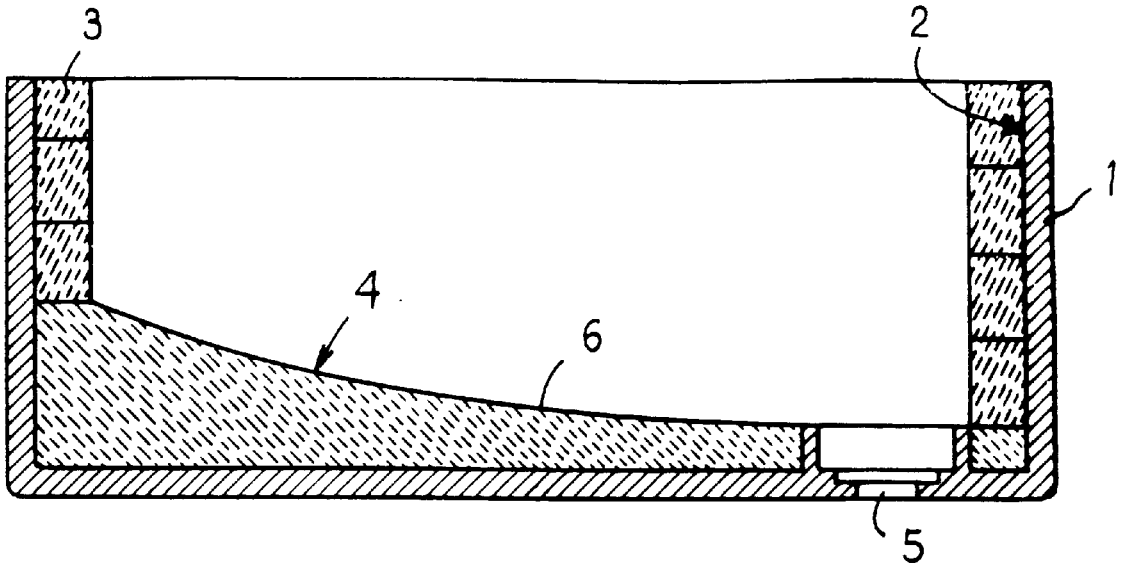
FIG. 1 is a partial sectional view of a first embodiment of a ladle for the preaparation of metal according to the invention.

Shown in FIG. 1 is the lower part of a ladle for the preparation of metal, for example steel, comprising a metal case 1 which is for example cylindrical and provided on its inner surface 2 with a refractory wall lining 3 and a refractory bottom lining 4 with a taphole 5.

The refractory bottom lining 4 is composed of a refractory layer having a surface 6 in contact with the metal in preparation which is a concave surface having at every point a slope in the direction toward the taphole 5.

The concave shape 6 of the refractory bottom lining 4 produces a vault effect when the ladle is turned over and this vault effect prevents the detachment of the refractory bottom lining 4.

Figure 2:
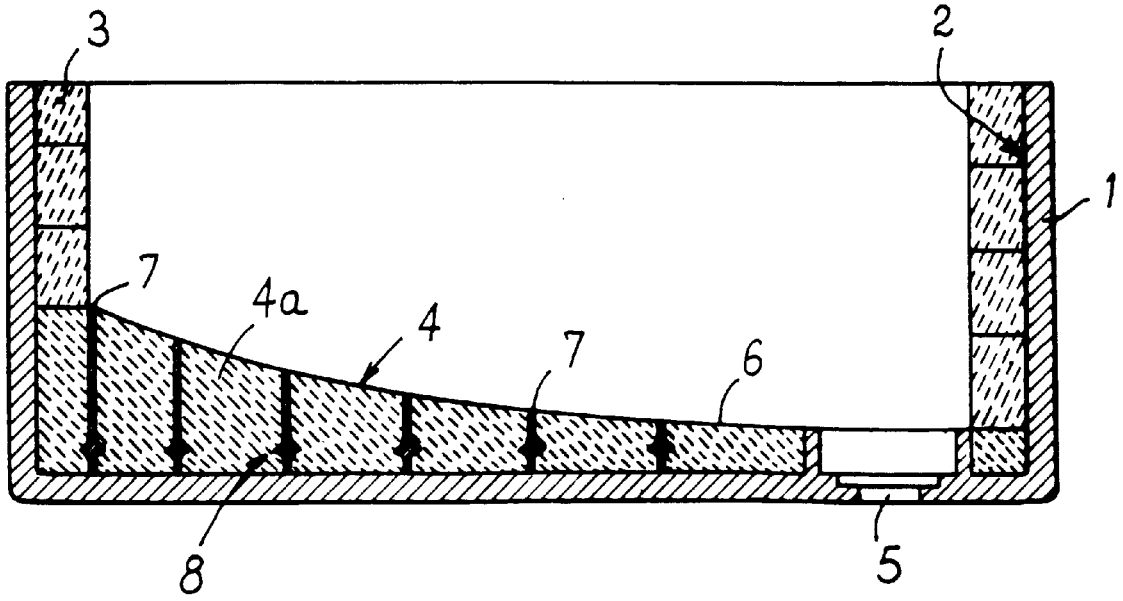
FIG. 2 is a partial sectional view of a second embodiment of a ladle according to the invention.

In a second embodiment shown in FIG. 2, the refractory bottom lining 4 is formed by an assembly of a plurality of independent elements 4*a* separated by joints 7 of refractory concrete.

The independent elements 4*a* constituting the refractory bottom lining 4 are produced for example by moulding and each have a specific shape for their fitting together in the bottom of the metal case 1 of the ladle.

Their disposition and their shape are such as to achieve a vault effect when the ladle is turned over.

The joints 7 are preferably placed, on one hand, concentrically relative to the taphole 5 and, on the other hand, in radial directions relative to the taphole, the radiating joints being moreover offset from one concentric joint to the other.

The lateral surfaces of the independent elements 4*a* are provided with grooves 8 forming on the joints 7 projections which preclude the sliding of the elements 4*a* relative to one another.

The grooves 8 extend in a direction substantially parallel to the surface of the ladle bottom.

The independent elements are jointed with a refractory concrete having a permanent positive remanent dimension variation, the other physical properties of the sealing concrete being close to those of the refractory material employed for producing the independent elements 4*a*.

The sealing concrete which forms the joints 7 is so disposed as to balance or compensate for expansion deformations due to the geometry of the assembly of the independent elements 4*a*.

Figure 3:
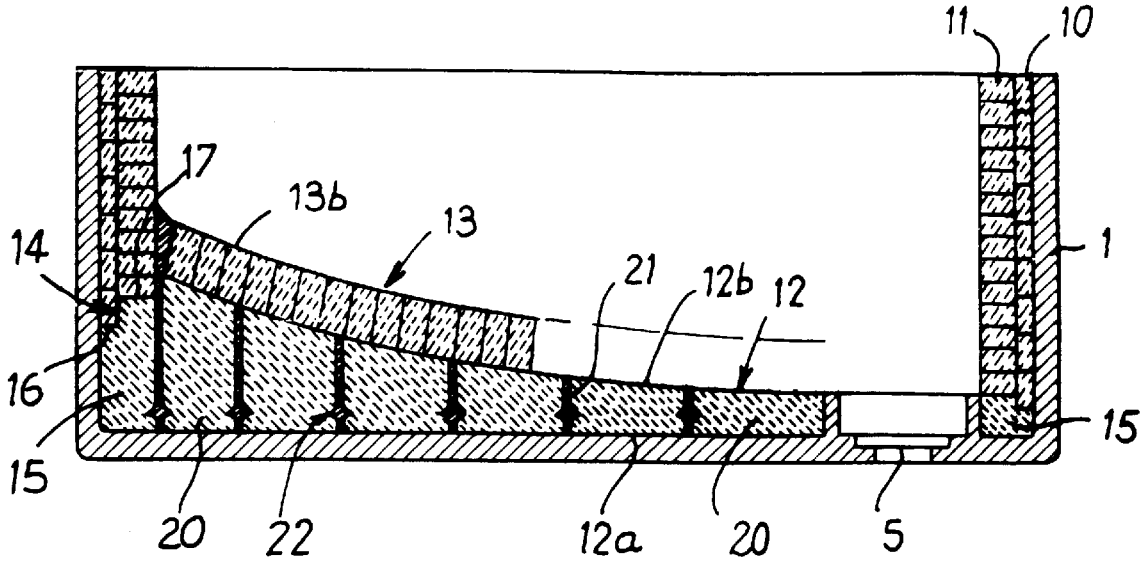
FIG. 3 is a partial sectional view of a third embodiment of a ladle according to the invention.

In a third embodiment shown in FIG. 3, the refractory wall lining comprises at least one safety layer 10 and at least one wear layer 11, and the refractory bottom lining includes at least one safety layer 12 and at least one wear layer 13.

The wear layers 11, 13 are in the form of refractory bricks the quality of which is determined by the conditions of utilisation and the stresses to which they are subjected in the various parts of the refractory lining of the ladle. These bricks may be manufactured from, in particular aluminous, aggregates of dolomite or magnesia.

The bricks constituting the safety layer 10 and the wear layer 11, for example of semi-universal shape, bear against an outer shoulder 14 of an annular ramp 15 for commencing the masonry of the bricks of the refractory wall lining. The outer shoulder 14 defines two helical support surfaces 16 and 17 respectively. The support surface 16 has the width of the safety layer 10 of the wall and the support surface 17 has the width of the wear layer 11 of the wall.

Furthermore, the outer shoulder 14 constitutes a means for the peripheral blocking of the safety layer 12 of the ladle bottom.

To this end, there is laid on the bottom of the ladle in the space defined by the annular ramp 15, the safety layer 12 of the ladle bottom of lenticular shape and having a planar surface 12*a* sealed to the inner surface of the bottom of the metal case 1 and a surface 12*b* which is concave and sufficiently spherical having at every point a slope in the direction toward the taphole 5.

Masoned to the concave surface 12*b* is the bottom wear layer 13 of refractory bricks which marry up with the shape of the concavity.

The surface 13*b* of the bottom wear layer 13 in contact with the metal in preparation defines a sphere whose centre is located on the longitudinal axis of the taphole 5.

The bottom wear layer 13 bearing on the concave substantially spherical surface 12*b* of the bottom safety layer 12 has, by a vault effect, a tendency to be urged flat against said safety layer 12 upon thermal expansion, which ensures that it is mechanically held together when the ladle is turned over.

The annular ramp 15 and the bottom safety layer 12 are both formed by the same material which is generally an aluminous concrete based on andalusite. This refractory concrete must have a good mechanical resistance in the cold state and an acceptable pyroscopic resistance.

Figure 4:
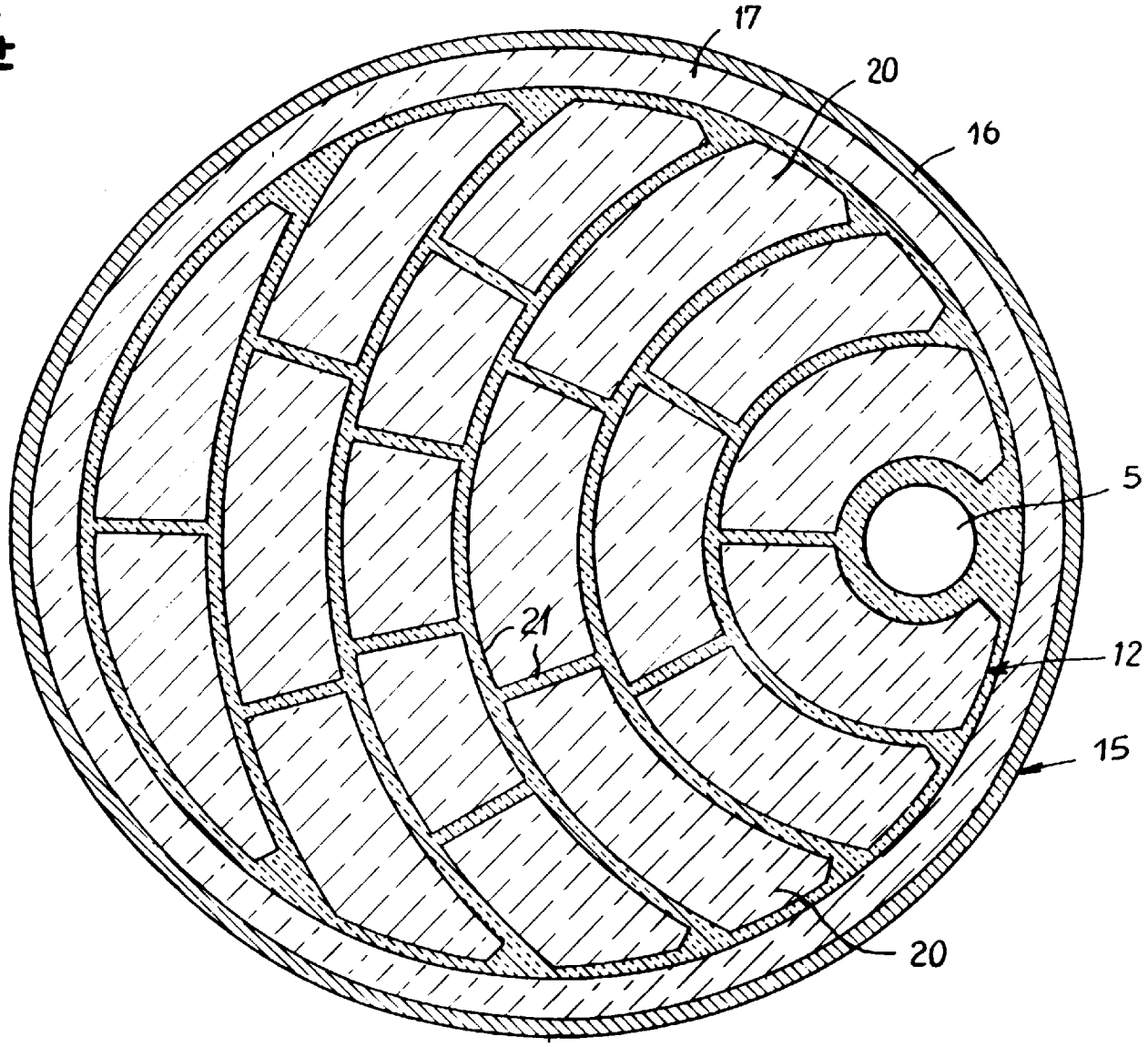
FIG. 4 is a top plan view of an assembly formed by an annular ramp for commencing the masonry of the wall bricks and by a bottom lining of a ladle according to the invention.

FIG. 4 is a top plan view of the assembly comprising the annular ramp 15 and the bottom safety layer 12.

The annular ramp 15 on which is moulded the outer shoulder 14 forming the two helical ramps 16 and 17 respectively for commencing the masonry of the refractory wall lining bricks, is poured on the spot. The bottom safety layer 12 is formed by an assembly of elements 20 constituting a mosaic and jointed with a concrete having a thermal expansion coefficient slightly higher than the thermal expansion coefficient of the refractory material constituting said independent elements 20. The other physical properties of the sealing concrete constituting the joints 21 between the independent elements 20 are close to those of the refractory material employed for producing said indpendent elements 20.

The joints 21 are disposed in such manner as to balance or compensate for the expansion deformations due to the geometry of the assembly of the independent elements. The joints 21 are preferably placed, on one hand, to be concentric with the taphole 5 and, on the other hand, to radiate relative to the taphole 5, the radiating joints being moreover arranged in staggered relation to one another.

The lateral surfaces of the independent elements 20 are also provided with a groove 22 which forms projections on the poured joints 21 which preclude the sliding of the independent elements 20 of the safety layer 12 relative to one another.

Figure 5:
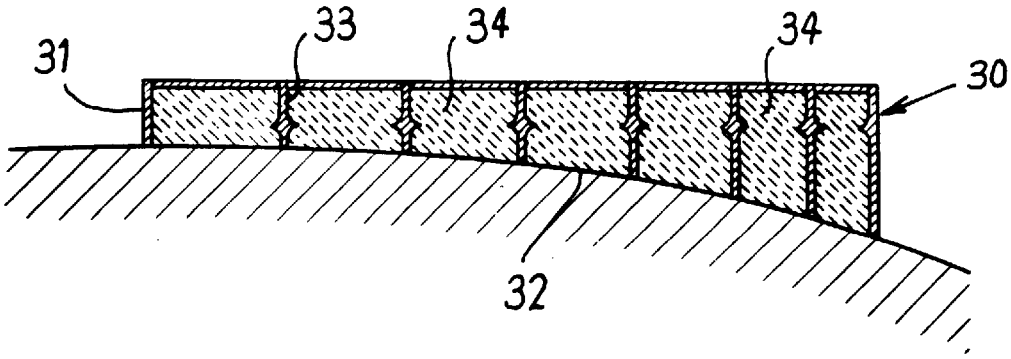
FIG. 5 is a sectional view of a mould in which are poured the independent elements of the mosaic forming a refractory bottom lining of a ladle according to the invention.

With reference now to FIG. 5, there will be described the method for prefabricating independent elements 4*a*, 20 of the mosaic of the bottom lining 4 or of the bottom safety layer 12.

For this purpose, there is employed a mould 30 shaped as a form for the refractory bottom lining 4 or the bottom safety layer 12. The mould 30 is constituted by a cylinder 31 placed on a convex surface 32 producing the curvature of the surface of the bottom refractory lining 4 or of the ladle bottom safety layer 12. The mould 30 is partitioned with vertical partition walls 33 whose section corresponds to the shape of the joints 7, 21, said vertical walls 33 being placed in such manner as to define compartments forming moulds for the elements 4*a*, 20 respectively of the bottom refractory lining or of the safety layer 12.

After the refractory material 34 has been poured into the different moulds constituting the mosaic and has been stripped from these moulds, the elements 4*a*, 20 of specific shape are given references. They together constitute either a refractory bottom lining 4 or a safety bottom layer 12 of homogenous physical characteristic.

Although the concave shape of the surface in contact with the metal in preparation is of substantially spherical shape in the described examples, other shapes would be suitable, such as a cylindrical or ogival shape, these shapes producing a vault effect on the refractory bottom lining and ensuring its correct mechanical performance.

Furthermore, such a configuration ensures that the steel flows well toward the taphole, the lowermost point of the surface of the bottom refractory lining of the ladle being formed by said taphole.

What is claimed is:

1. A ladle for the preparation of metal and adapted to be turned over, comprising:

an open-top metal case having a generally cylindrical side wall and a generally flat circular bottom, a refractory side wall lining and a refractory bottom lining having a tap hole disposed on an inner surface of said case, wherein a surface of said bottom lining for contacting the metal in preparation is concavely curved and having at every point a slope in a direction toward said tap hole, wherein said tap hole is eccentrically located with respect to the center of said bottom, wherein said refractory bottom lining is formed by at least an assembly of independent elements with joints therebetween, and wherein said assembly of the independent elements forms a mosaic having joints, some of said joints being arcuate and concentric with the tap hole and remaining joints radiating relative to the arcuate joints, the radiating joints being offset from one concentric joint to another concentric joint.

2. A method for producing a refractory bottom lining for a ladle for the preparation of metal and adapted to be turned over, the ladle having an open top metal case to be lined that has a generally cylindrical side wall and a generally flat bottom, the bottom lining having a tap hole therein, eccentrically located with respect to the center of the lining and the bottom lining comprising an assembly of independent elements separated by joints and the surface of the refractory bottom lining being in contact with the metal in preparation and being concavely curved and having at every point a slope in a direction toward the tap hole, the method comprising the steps of:

producing a mold having a bottom that is convexly curved corresponding to the concave curvature of the surface of the bottom lining and having vertical partitioning walls defining compartments corresponding to the geometry of the elements of the refractory bottom lining, the walls having a section corresponding to the section of the joints;

pouring into each of the compartments a selected refractory concrete and allowing it to set to form the elements; and stripping the elements from the mold and providing each with a reference.

3. A ladle according to claim 1, wherein the refractory bottom lining comprises at least one safety layer and at least one wear layer, said safety layer being formed by an assembly of independent elements separated by joints.

4. A ladle according to claim 1, wherein the assembly of independent elements forming the refractory bottom lining, said independent elements are constructed and disposed in such manner as to produce a vault effect when the ladle is turned over.

5. A ladle according to claim 1, wherein the independent elements are molded elements.

6. A ladle according to claim 1, wherein the independent elements have lateral surfaces provided with at least one groove extending in a direction substantially parallel to the surface of a bottom of the metal case.

7. A ladle according to claim 1, wherein the independent elements are sealed with concrete having a permanent positive remanent dimension variation.

8. A ladle according to claim 3, wherein the safety layer is surrounded by an annular girdle forming a surface for supporting and commencing the masonry of the refractory lining of the wall of the meatal case.

9. A ladle according to claim 8, wherein the annular girdle having a substantially quadrilateral section includes at least one outer shoulder defining at least one helical support surface, said support surface having a width corresponding to the thickness of at least one layer of refractory wall lining.

* * * * *